US005237744A

United States Patent [19]

Himmeroeder

[11] Patent Number: 5,237,744

[45] Date of Patent: Aug. 24, 1993

[54] METHOD OF COLD-FORMING TOOTHED WHEELS

[75] Inventor: Helge Himmeroeder, Barrie, Canada

[73] Assignee: Tesma International Inc., Markham, Canada

[21] Appl. No.: 935,388

[22] Filed: Aug. 26, 1992

Related U.S. Application Data

[63] Continuation-in-part of Ser. No. 837,399, Feb. 19, 1992, Pat. No. 5,152,061.

[51] Int. Cl.[5] ..... B21D 53/28

[52] U.S. Cl. ..... 29/893.32; 72/68; 74/449; 74/457; 74/460

[58] Field of Search ..... 29/893.32, 892.3; 72/68, 102, 107, 109, 110; 74/438, 449, 457, 460

[56] References Cited

U.S. PATENT DOCUMENTS

| | | | |
|---|---|---|---|
| 1,377,175 | 5/1921 | Anderson | 29/893.32 |
| 3,631,704 | 1/1972 | Leonard et al. | 29/893.32 |
| 3,745,851 | 7/1973 | Zeldman et al. | 29/893.32 |
| 3,894,418 | 7/1975 | Hörl | 29/893.32 |
| 4,796,345 | 1/1989 | Krapfenbauer | 74/438 |
| 4,945,783 | 8/1990 | Grob | 29/893.3 |

FOREIGN PATENT DOCUMENTS

| | | | |
|---|---|---|---|
| 379364 | 7/1990 | European Pat. Off. | 74/449 |
| 102277 | 8/1979 | Japan | 72/110 |
| 101034 | 5/1988 | Japan | 72/68 |
| 286232 | 11/1988 | Japan | 29/893.32 |
| 755395 | 8/1980 | U.S.S.R. | 29/893.32 |
| 1248710 | 8/1986 | U.S.S.R. | 29/893.32 |

*Primary Examiner*—P. W. Echols

*Attorney, Agent, or Firm*—Cushman, Darby & Cushman

[57] ABSTRACT

A method of forming a one-piece sheet metal toothed wheel comprising the steps of rotating (1) a rotary holding unit with the preform secured thereto about the preform axis and an inner portion of an outer annular section of the preform within a back-up space provided by the holding unit, and (2) a tooth-forming tool unit about the rotational axis thereof in a predetermined rotational relation wherein the axes are parallel and the rotational speeds are synchronized, and then while the rotary holding unit with the preform secured thereto and the tooth-forming tool unit are in the predetermined rotational relation affecting relative movement between the units and the axes thereof in a direction toward one another to engage the tooth-forming periphery fo the tooth-forming tool unit in cooperation metal-deforming relation with the outer portion of the outer annular section inwardly of the exterior periphery the preform until the sheet metal of the outer portion of the annular section is cold-formed into the series of teeth and displaced from the troughs therebetween so that after the series of teeth are cold-formed the toothed wheel includes a back-up portion having surfaces conforming to the back-up space, the peripheries of the series of teeth being cold-formed by rolling contact with the tooth-forming periphery of the tooth forming tool unit and the sides of the series of teeth including portions disposed outwardly beyond the spaced tooth side defining planes being free-formed without surface, contact by the axially outward movement of the metal defining the outer portion of the outer annular section.

11 Claims, 4 Drawing Sheets

114

161
154
146
162
158
164
150
166
112
156
152
160
148
169
168
163

154
162
172
112
152
166
164
170

156
163
161
214

261
262
246
212
254
258
264
268
269
256
260
252
263
266

262
258
264
212
254
256
252
260
266
170
261
263

METHOD OF COLD-FORMING TOOTHED WHEELS

The application constitutes a continuation-in-part of my copending patent application Ser. No. 07/837,399, filed Feb. 19, 1992, entitled Cold-Forming of Toothed Wheels from Sheet Steel now U.S. Pat. No. 5,152,061.

This invention relates to toothed wheels of the type utilized in motor vehicles as, for example, in the starter assembly thereof and more particularly to improvements in the method of making such toothed wheels.

In my '399 application, the disclosure of which is hereby incorporated by reference into the present specification, there is disclosed a method of forming a toothed wheel including a series of cold-formed peripheral teeth having sides spaced apart a predetermined distance utilizing (1) a rotary holding unit having structure providing a generally radially outwardly facing control surface and (2) a rotary tooth-forming tool unit having a rotational axis and a tooth-forming periphery extending annularly about the rotational axis. One of the rotary units includes two annular flanges extending outwardly thereof having two smooth tooth-side forming surfaces facing toward one another spaced apart the predetermined distance. The method of the '399 application comprises the initial step of cold-forming a circular piece of sheet metal of predetermined thickness into a preform having an outer annular section of generally uniform cross-sectional configuration and an integral sheet metal central wall generally of the predetermined thickness extending annularly inwardly from the outer annular section toward a preform axis, the outer annular section having (1) a width greater than the predetermined thickness but no greater than the predetermined distance, and (2) an outer periphery which will allow a meshing action with the tooth-forming periphery of the tooth-forming tool unit. The method of the '399 application also includes the step of rotating (1) the rotary holding unit with the preform secured thereto about the preform axis and with the control surface underlying at least a portion of the annular section and (2) the tooth-forming tool unit about the rotational axis thereof in a predetermined rotational relation wherein the axes are parallel and the rotational speeds are synchronized. While the rotary holding unit with the preform secured thereto and the tooth-forming tool unit are in the predetermined rotational relation, the method of the '399 application further includes the step of affecting a relative movement between the units and the axes thereof in a direction toward one another to engage the tooth-forming periphery of the tooth-forming tool unit in cooperating metal-deforming relation with the annular section inwardly of the exterior periphery thereof until the sheet metal of the annular section is cold-formed into the series of teeth, the peripheries of which are cold-formed by rolling contact with the tooth-forming periphery of the tooth-forming tool unit and portions of the sides of which are smooth and cold-formed by contact with the smooth tooth-side forming surface so that an amount of sheet metal which would otherwise uncontrollably flow axially outwardly of the smooth tooth-side forming surfaces is concentrated within the teeth and/or the radially inward back-up therefor.

It has been found that, while the total confinement of the metal during the cold-forming operation has the advantages stated, there also existed a tendency to break teeth off the rotary tooth-forming tool unit after a period of operation which, on occasion, would be substantially less than the normal expected operative life of the tool unit. The frequency of tooth failure was considered unexpected particularly in the tool construction where the two annular flanges for forming the two smooth tooth sides were integrally interconnected on opposite sides of the forming teeth.

An object of the present invention is to overcome the problem of frequency of tooth failure in the rotary tooth forming unit of the above described method of the '399 application. In accordance with the principles of the present invention this objective is achieved by providing a method of forming a one-piece sheet metal toothed wheel including a central sheet metal wall of predetermined thickness and a series of cold-formed integral teeth on the periphery of the central wall defined by troughs extending radially inwardly therebetween to a cylindrical trough plane concentric with an axis of the central wall, the series of cold-formed integral teeth having an operative width defined by spaced tooth side defining planes. The method utilizes (1) a rotary holding unit which in holding operation provides an inner pair of opposed central wall-engaging surfaces extending generally radially outwardly to a cylindrical inner plane spaced inwardly from an outer cylindrical plane of a size equal to the trough plane and an outer pair of back-up surfaces extending from the inner pair of opposed central wall-engaging surfaces at the inner plane to the outer plane where the outer pair of surfaces are spaced apart a predetermined distance which is greater than the spacing between the inner pair of surfaces so as to define a back-up space within an annulus between the inner and outer planes and (2) a rotary tooth-forming tool unit having a rotational axis and a tooth-forming periphery extending annularly about the rotational axis. The method comprises a combination of steps the initial one of which is cold-forming a circular piece of sheet metal into a preform having an outer annular section of generally uniform cross-sectional configuration and an integral sheet metal central wall generally of the predetermined thickness extending generally radially inwardly from the outer annular section toward a preform axis. The outer annular section has (1) a width greater than the predetermined thickness but no greater than the predetermined distance, and (2) an outer periphery extending beyond the trough plane which will allow a meshing action with the tooth-forming periphery of the tooth-forming tool unit. The next step is rotating (1) the rotary holding unit with the preform secured thereto about the preform axis and an inner portion of the outer annular section within the back-up space and an outer portion of the outer annular section extending radially outwardly of the back-up space, and (2) the tooth-forming tool unit about the rotational axis thereof in a predetermined rotational relation wherein the axes are parallel and the rotational speeds are synchronized. The third step is performed while the rotary holding unit with the preform secured thereto and the tooth-forming tool unit are in the predetermined rotational relation affecting a relative movement between the units and the axes thereof in a direction toward one another to engage the tooth-forming periphery of the tooth-forming tool unit in cooperating metal-deforming relation with the outer portion of the outer annular section inwardly of the exterior periphery thereof until the sheet metal of the outer portion of the annular section is cold-formed into the series of teeth and displaced from the troughs therebetween so that after the series of teeth are cold-formed the toothed wheel includes a back-up portion having surfaces conforming to an outer extent of each of the outer pair of surfaces defining the back-up space, the peripheries of the series of teeth being cold-formed by rolling contact with the tooth-forming periphery of the tooth-forming tool unit and the sides of the series of teeth including portions disposed outwardly beyond the spaced tooth side defining planes being free-formed without surface contact by the axially outward movement of the metal defining the outer portion of the outer annular section.

Preferably, the rotary holding tool unit further provides a pair of cylindrical exterior peripheral surfaces extending axially in opposite directions from the outer pair of surfaces within the outer plane and the tooth forming periphery of the tooth forming tool unit includes trough forming teeth-like projections having exterior tips which extend to said trough plane. Preferably, in the third step, at the end of the relative movement between the units towards one another to engage the tooth forming periphery of the tooth forming tool unit in cooperating relation with the outer portion of the outer annular section, the tips substantially engage the exterior periphery surfaces of the rotary holding unit.

Preferably, the spaced tooth side defining planes pass generally through the outer pair of surfaces spaced apart within the outer plane. Preferably, the method includes a fourth step which is the machining of the free-formed portions of the sides of the series of teeth at least along one common side so that the machined sides of the teeth on the one common side are disposed in a common plane constituting one of the spaced tooth side defining planes.

Another object of the present invention is to provide a method of cold forming which is cost effective.

These and other objects of the present invention will become more apparent during the course of the following detailed description and appended claims.

The invention may best be understood with reference to the accompanying drawings wherein an illustrative embodiment is shown.

IN THE DRAWINGS

Figure 1:
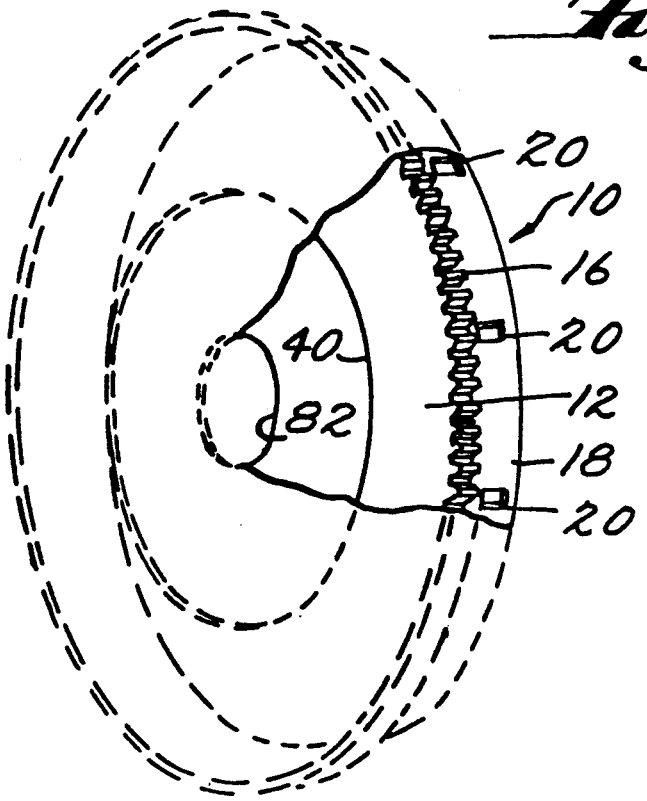
FIG. 1 is a perspective view partly in solid lines and partly in dotted lines of a starter gear with an integral pulse ring constructed in accordance with the method of the present invention.
Figure 2:
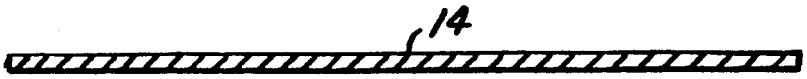
FIG. 2 is a fragmentary sectional view of one-half of a circular piece of sheet metal which constitutes the starting material in practicing the principles of the present invention.

Referring now more particularly to FIGS. 1–7, there is shown therein a toothed wheel in the form of a starter gear, generally indicated at 10, constructed in accordance with the principles of the present invention. FIGS. 2–6 illustrate various steps in the method of making the starter gear 10 in accordance with one embodiment of the method of the present invention. As shown, the starter gear 10 is made from a single circular piece of sheet metal, as, for example, steel capable of being cold-formed. As best shown in FIG. 1, the starter gear 10 includes a central wall 12 of sheet metal having a thickness generally equal to the predetermined thickness of the sheet metal which forms the starting material. FIG. 2 illustrates in cross-section one-half of a circular piece of sheet metal 14 the formation of which constitutes a first step in the method of the present invention.

The starter gear 10 also includes an annular section formed integrally with the outer periphery of the central wall 12, a portion of which is cold-formed into a series of gear teeth 16 and a portion of which defines pulse ring 18 in the form of an axially extending cylindrical flange having a series of openings 20 extending radially therethrough at regular intervals. As shown, there are twelve openings 20 equally spaced annularly about the axis of the starter gear 10 with each opening 20 being of generally rectangular configuration.

Figure 3:
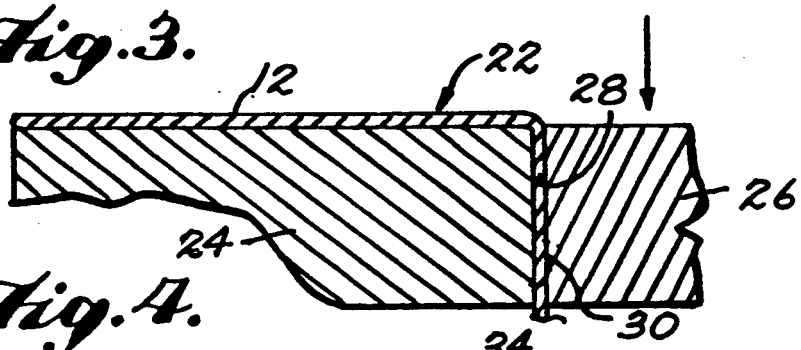
FIG. 3 is a view similar to FIG. 2 illustrating a first step in the process of the present invention wherein the circular piece of sheet metal is cold-formed into a can.

Referring now more particularly to FIG. 2, the circular piece of sheet metal 14 is illustrated therein to be a separate piece which may be stamped from a continuous sheet of steel. It will be understood that the separation of the circular starting piece 14 from a roll or continuous web of sheet material need not be accomplished in a single step wherein the circular piece 14 is produced for subsequent handling but may be only transitionally formed as a part of a multi-step sequence in the method. For example, the circular piece 14 could be a transitional part in the step of cold-forming a can 22. However, as shown in FIG. 3, the circular piece of sheet metal 14 is placed over a circular support 24 and a die 26 having a cylindrical opening 28 therein is moved axially so as to engage an outer annulus of the circular piece 14 and cold-form the outer annulus into a flange 30 extending axially from the outer periphery of a central wall 12 thereof.

Figure 4:
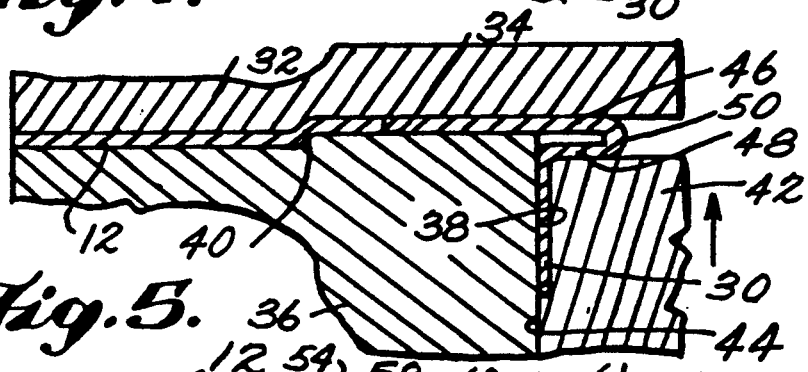
FIG. 4 is a view similar to FIG. 3 showing the next step in the method of the present invention including the formation of an annular section from the can.

Next, as shown in FIG. 4, the can 22 is placed so that the central wall 12 is in abutment with a support 32 having an annular recess 34 therein and a central plunger 36, which has an exterior cylindrical periphery 38 sized to engage within the axial flange 30 of the can 22, is moved toward the support 32 so as to form the central wall 12 of the can 22 with a central recess therein defined by an annular shoulder 40. A second outer annular plunger 42 is then moved toward the support 32 and the plunger 42 has an interior periphery 44 which is of notched cylindrical configuration so as to engage both the exterior surface and the end surface of the axial flange 30 of the can 22.

During the movement of the outer annular plunger 42 toward the support 32, the portion of the axial flange 30 adjacent the central wall 12 is bulged out so as to form two annular side-by-side wall portions 46 and 48, one of which is integral at its inner periphery with the outer periphery of the center wall 12 and the other of which is integral at its inner periphery with the adjacent end of the remaining portion of the axial flange 30. The outer periphery of both annular wall sections 46 and 48 are integrally interconnected as indicated at 50. At the end of these procedures, the original circular piece of sheet metal 14 has now been cold-formed into a non-thickened preform which includes the center wall 12 having an outer annular section integral with the outer periphery thereof, which includes the two side-by-side annular wall portions 46 and 48 and the remaining portion of the axial flange 30.

Figure 5:
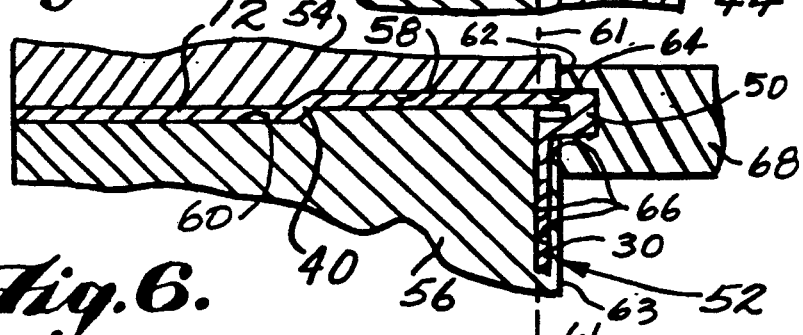
FIG. 5 is a view similar to FIG. 4 showing the next step in the method of the present invention wherein a final preform is cold-formed by thickening the annular section.

Referring now more particularly to FIG. 5, the unthickened preform is next secured with a rotary holding unit, generally indicated at 52, which includes a pair of complementary annular holding members 54 and 56. As shown in FIG. 5, the complementary holding members 54 and 56 provide, when in operative holding relation, an inner pair of opposed central wall engaging surfaces 58 and 60, respectively, which are spaced axially apart a distance equal to the predetermined thickness of the central wall 12 so as to allow the central wall 12 to be engaged therebetween. As shown in FIG. 5, the inner pair of opposed surfaces 58 and 60 extend generally radially outwardly to an inner cylindrical plane, indicated by the phantom line 61 in FIGS. 5 and 6, which is spaced inwardly from a pair of exterior peripheral surfaces 62 and 63 on the holding members 54 and 56 respectively.

The complementary holding members 54 and 56 also have an outer pair of back-up surfaces 64 and 66, respectively, extending from the inner pair of opposed central wall engaging surfaces 58 and 60 respectively, to exterior peripheral surfaces 62 and 63, respectively. The peripheral surfaces 62 and 63 are coincident with a cylindrical trough plane concentric with the axis of the central wall 12 which defines the inner extent of the troughs to be formed between the teeth on the preform. The outer extent of the surfaces 64 and 66 extend generally radially to the peripheral surfaces 62 and 63 in the trough plane in axially spaced relation. The axial spacing between the outer pair of surfaces 64 and 66 at the trough plane is a predetermined distance greater than the predetermined thickness of the central wall 12. It will also be noted that the surfaces 64 and 66 define a back-up space which is disposed within the annulus between the inner cylindrical plane 61 and the cylindrical trough plane.

In the operative secured relation of the holding members 54 and 56 with the non-thickened preform, the central wall 12 is engaged between the inner pair of opposed surfaces 58 and 60 and the flange 30 is engaged within the back-up space defined by the surface 66. The non-thickened preform thus secured in the rotary holding unit 52 is then cold-formed into a final thickened preform by moving a rotary thickening tool 68 radially inwardly into engagement with the connection 50 at the outer periphery of the annular wall portions 46 and 48 of the non-thickened preform while the rotary holding unit 52 is rotated to thus cold-form the outer periphery of the annular section radially inwardly into a configuration wherein the integral connection 50 between the two annular wall portions 46 and 48 is thickened as well as the adjacent portions of the annular wall portions themselves.

Figure 7:
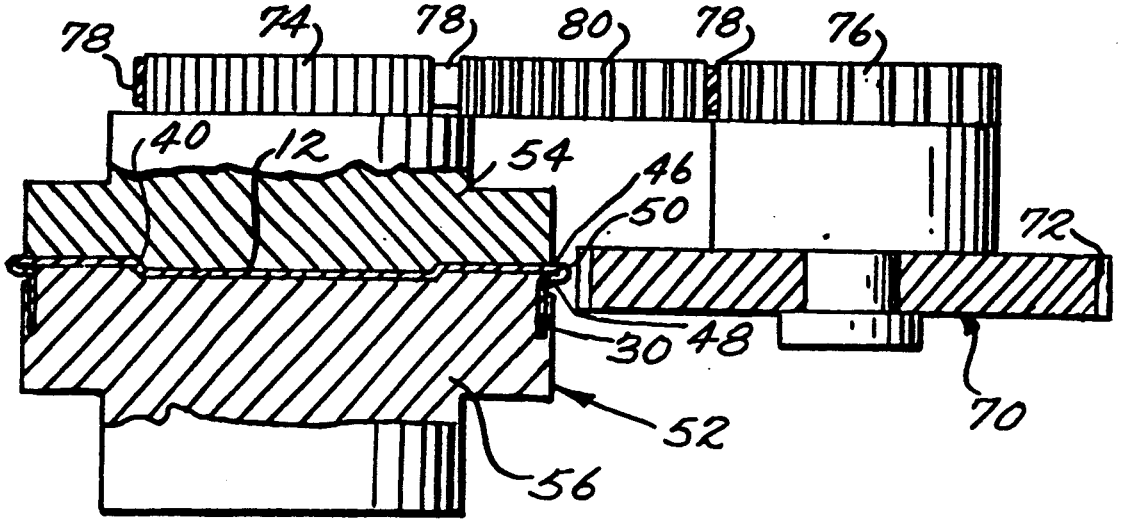
FIG. 7 is a sectional view illustrating the entire rotary holding unit and rotary tooth forming unit shown in FIG. 6.

The next cold-forming step in the present method is to cold-form the series of teeth 16 in the thickened annular section of the final preform while it is retained in secured relation with the rotary holding unit 52. FIG. 7 illustrates that the rotary holding unit 52 forms a part of a cold-forming machine capable of cold-forming the series of teeth 16 in the annular section of the preform. The cold-forming of the series of teeth 16 is accomplished by a rotary tooth forming tool unit, generally indicated at 70, having a tooth forming tool structure 72 on the exterior periphery thereof. The rotary tooth forming unit 70 forms a part of a machine which provides a means for effecting a rotational movement of the rotary holding unit 52 and the rotary tooth forming tool unit 70 in a predetermined rotational relationship wherein the axes are parallel and the rotational speeds are synchronized.

Any suitable motion-transmitting means may be provided in the machine for effecting the rotational relationship. For example, as shown, the rotary holding unit 52 has a timing belt pulley 74 fixed to rotate therewith and the rotary tooth forming tool unit 72 is likewise provided with a timing belt pulley 76 which rotates therewith. A timing belt 78 is trained about the two timing belt pulleys 74 and 76 and a pair of movable idler pulleys 80 in such a way that the rotational relationship between the two rotary units 52 and 70 is maintained while permitting a relative movement between the two units and the axes thereof toward and away from one another. The timing belt 78 is of a type which includes timing teeth on both the interior and exterior surfaces thereof. The teeth on the interior periphery, as shown, are trained about the exterior periphery of the timing belt pulley 76 fixed with respect to the rotary holding unit 52 while the exterior teeth of the timing belt 78 are trained about the timing belt pulley 76 fixed to the rotary tooth forming tool unit 70. The two idler pulleys 80, which are on opposite sides of a plane passing through the axes of rotation of the two units, are movable to take up any belt configuration change as a result of the relative movement of the two units toward and away from one another with the movement of the idlers 80 being commensurate so as to maintain the synchronous rotational movement.

In this regard, it will be noted that the directions of rotation of the rotary units 52 and 70 are in opposite directions so that the tooth forming periphery 72 of the rotary tool unit 70 can be moved into meshing relation with the periphery of the annular section of the preform secured to the rotary holding unit 52. It will also be noted that the thickness of the preformed annular section is greater than the predetermined sheet metal thickness and no greater than the predetermined distance between surfaces 64 and 66. More specifically, as shown, the thickness of the annular section is slightly greater than twice the predetermined thickness of the sheet metal but less than the predetermined distance between the tooth side forming surfaces 64 and 66.

Once the predetermined rotational relationship has been established, the two rotary units 52 and 70 will be rotated in the predetermined rotational relationship which, for example, is an identical speed in opposite directions of 150–180 revolutions per minute. With the two rotary units 52 and 70 in the position shown in FIG.

7 and while the rotational relationship is retained, a relative movement between the two rotary units and their parallel vertical axes (as viewed in FIG. 7) in a direction toward one another is effected. Preferably, the rotary tool unit 70 is moved while the axis of rotation of the rotary holding unit 52 is held stationary; although both units could be moved or only the rotary unit 52 could be moved. An exemplary feed rate of the movement of the axis of the rotary tool unit 70 toward the axis of the rotary holding unit 52 is approximately 120 mm per minute. As the outer tool forming periphery 72 of the tool forming tool unit 70 moves to engage the periphery of the annular section of the preform in cooperating metal deforming relation inwardly of the exterior periphery thereof, the sheet metal of the annular section is cold-formed into a series of teeth. Preferably, this is accomplished by effecting a movement of the rotary tool unit 70 toward the holder unit to an extent which equals about four meshing turns. When this feed movement has been reached, the drive for the two units is reversed and then the feed movement is advanced until four more meshing turns are accomplished. These alternative direction feeds are repeated until the full tooth configuration has been completed.

Thus, during the infeed, the peripheries of the series of teeth 16 are cold-formed by rolling contact with the tooth forming periphery 72 of the tooth forming tool unit 70. The tooth forming periphery 72 consists of teeth-like projections with trough-like spaces therebetween. The trough-like spaces form the teeth on the preform and the teeth-like projections form the troughs between the teeth on the preform. The tips of the teeth-like projections form the bottom of the troughs. It is noted that the width of the teeth-like projections is greater than the width of the teeth which are formed on the preform. During the formation of the teeth on the preform, the preform material which is initially disposed in the spaces where the troughs are finally provided is moved by the teeth-like projections of the tooth forming periphery 72 either radially inwardly into the back-up space or axially outwardly. Because of the greater width of the teeth-like projections, the axial movement must be accompanied by movements in opposite circumferential directions. This circumferential movement results in a build-up of material on both sides of the teeth being formed on the preform. This build-up of the sides of the teeth is allowed to take place on a free-forming basis in the preferred configuration of the tooth-forming periphery 72 wherein the teeth-like projections are of uniform cross-sectional configuration across their entire width. In this preferred configuration, there are no spaced tooth-side defining flanges such as provided in some of the tooth-forming peripheral configuration in the '399 application. With the preferred configuration, the entire sides of the teeth of the preform are free formed. It is within the contemplation of the present invention to provide flanges on the tooth-forming periphery 72 at the positions where it is desired to have the sides of the teeth end so long as the flanges are slotted or otherwise relieved so as to insure that at least portions of the sides of the teeth are free formed. The amount of relief provided should be sufficient to overcome the problem of premature breakage of the teeth-like projections of the tooth-forming periphery heretofore experienced as aforesaid.

Figure 6:
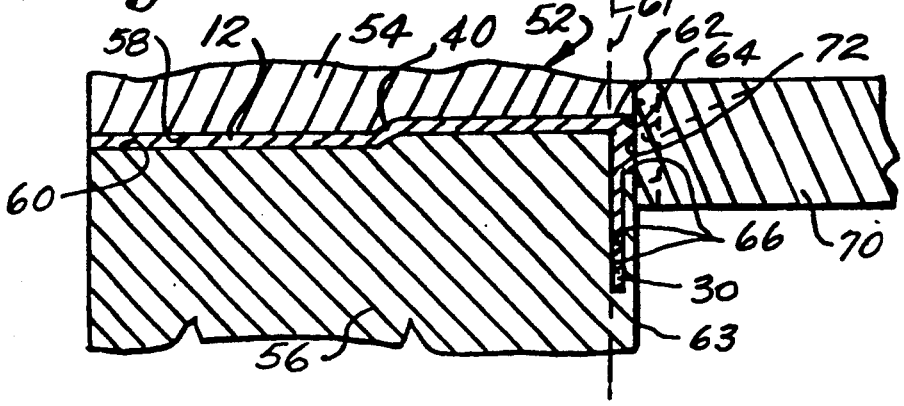
FIG. 6 is a view similar to FIG. 5 showing the teeth forming step in the method of the present invention wherein the thickened annular section of the preform is cold-formed into a series of teeth.

In the preferred embodiment shown where the flanges are effectively slotted with a cross-sectional configuration the same as the trough-like depressions of the tooth-forming periphery 72, the desired width of the teeth formed on the preform generally conforms to axially spaced planes passing through the juncture between the peripheral surfaces 62 and 63 with the outer pair of surfaces 64 and 66. FIG. 6 shows the position of the tooth-forming periphery 72 with respect to the preform at the end of the relative movement of the units toward one another. It will be noted that the tip of the tooth-like projections extend to the trough plane of the formed teeth and that opposite end portions of the tips are substantially in engagement with the exterior peripheral surfaces 62 and 63. It will also be noted that the back-up space is filled with preform material. In this regard, it will be noted that the portion of surface 66 which extends axially in the plane 61 limits the amount of radially inward movement of preform material which can occur during the formation of the teeth. Preferably, the limitation is enough to fill the entire back-up space in the areas of the formed teeth as well as the formed trough shown in the cross-section of FIG. 6. In its broadest aspects, the invention contemplates that some void areas, as, for example, where the teeth are, can exist within the back-up space after tooth formation. With the preferred embodiment as shown in FIG. 6, the filling of the back-up space results in the free-forming of the sides of the teeth beyond the desired width of the aforesaid two planes.

It is greatly preferred that the annular section of the preform have an outer peripheral dimension which is at least as great as the crest dimension of the series of teeth and does not exceed this dimension by more than approximately 7% or functionally an amount which would enable a meshing relationship between the annular section of the preform and the periphery of the tooth forming tool unit when initial engagement occurs. This size relationship insures that it is not necessary to cause cold flow in a radially outward direction but rather that the direction of cold flow of metal is either axially outwardly or radially inwardly or a combination of both. It will be understaood however that, in its broadest aspects, the method does comprehend cold flow radially outwardly.

In its broadest aspects, the present invention contemplates having the sides free-formed, however, preferably, the method of the present invention contemplates machining one or both of the sides of the teeth so that the sides are coincident with the desired spaced planes. In the embodiment thus far described, only the free-formed side in alignment with surface 64 is machined and the other is left free-formed with the flange 30 extending outwardly thereof. This relationship is evident from the perspective view of the completed toothed wheel 10 shown in FIG. 1.

As best shown in FIG. 1, the central wall 12 is centrally apertured, as indicated at 82, which is a cold-forming step that may be accomplished after the series of teeth 16 are cold-formed or preferably this opening is formed prior thereto. Another cold-forming step which is made after the series of teeth 16 have been cold-formed is the stamping of the series of openings 20 of rectangular configuration at regular intervals along the remaining portion of the axial flange 30. The exterior surface of the remaining portion of the axial flange 30 is preferably machined in a lathe to form the pulse ring 18 with an accurate cylindrical exterior surface which intersects with the openings 20 to accurately provide signals at regular intervals which are used to provide computer control for the engine.

In the case of the starter gear 10 made in accordance with the above procedure, it is desirable that the final configuration be given a heat treatment at least in the area of the series of teeth 16. Preferably, the heat treatment is by induction heating to a temperature of 850° C. to 900° C. followed by quenching in water to room temperature. Heat treatment is considered desirable in the case of a starting gear because of the severe loads which are imposed along the volute surfaces of the teeth in operation. With the present invention, the teeth can be made to be substantially solid in the central area where the load is supplied by providing enough material in the perform to insure that the back-up space is filled. However, as previously indicated in its broader aspects, the back-up space can have void areas. In forming other toothed wheels, such as timing belt pulleys and pulse rings, the provision of an integral pulse ring with the series of teeth may be eliminated and the heat treatments can likewise be eliminated.

Figures 8, 9, 10, 11, 12, 13:
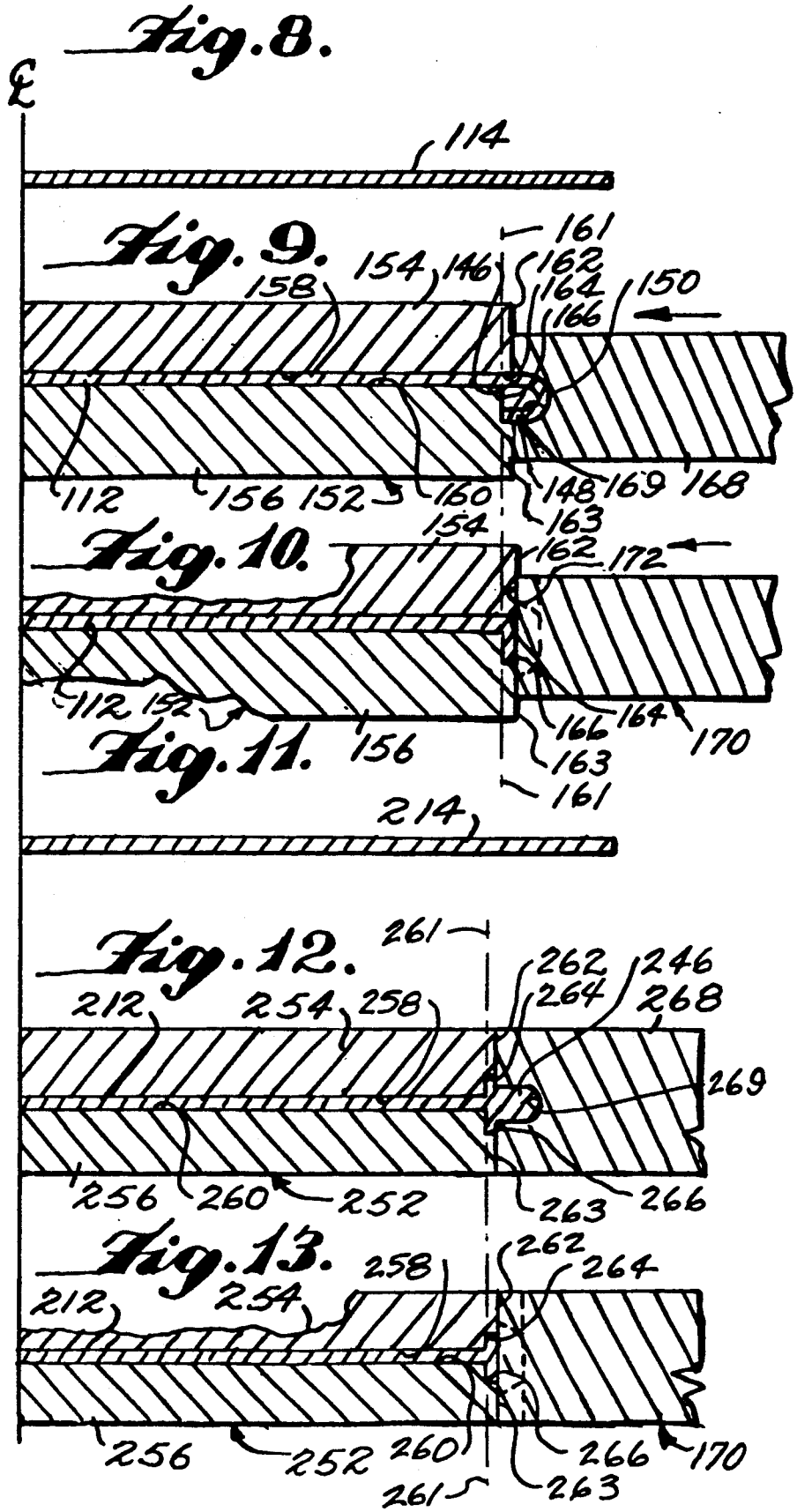
FIGS. 8, 9 and 10 are views similar to FIGS. 2–6 illustrating steps in performing another embodiment of the method of the present invention.
FIGS. 11–13 are views similar to FIGS. 8–10 illustrating steps in still another embodiment of the method of the present invention.

FIGS. 8–10 illustrate additional method step variations which are within the contemplation of the present invention. FIG. 8 illustrates a circular piece of sheet metal 114 of predetermined thickness which is secured in a rotary holding unit 152 of modified form including first and second annular holding members 154 and 156. As shown, the holding members 154 and 156 are formed with an inner pair of oppositely facing central wall engaging surfaces 158 and 160 which are adapted to engage the central wall 112 when in operative holding relation therewith. As before, the inner pair of surfaces 158 and 160 extend outwardly to an inner cylindrical plane 161 which is inwardly of the trough plane of the finished toothed wheel. As before, the holding members 154 and 156 include outwardly facing exterior peripheral surfaces 162 and 163, respectively, which are disposed within the trough plane. An outer pair of surfaces 164 and 166 respectively extend from the surfaces 158 and 160 in plane 161 to the surfaces 162 and 163, respectively, so as to define a back-up space between the plane 161 and the trough plane.

The holding members 154 and 156 in operative holding relation cooperate with a rotary preform rolling member 168 having a U-shaped groove 169 formed in its outer periphery. By advancing the rotary preform rolling member 168 with respect to the rotary holding unit 152 in a manner similar to the rotary member 68 previously described, an outer annulus of the circular piece 114 extending radially outwardly beyond the surface 162 is cold-formed into a peripheral flange extending outwardly and then downwardly from a curved control portion so as to provide a cross-sectional configuration which opens generally radially inwardly. While final configuration of the annular section which is cold-formed by the preform rolling member 168 could be of inverted semi-circular shape, the configuration is more of an inverted U-shape having a pair of side-by-side annular wall portions 146 and 148 integrally interconnected by a central arcuate transitional wall portion 150.

It will be understood that the annular section provided by wall portions 146, 148, and 150 could be thickened by utilizing a thickening tool similar to the tool 68; however, in the method according to 8–10, the next step is to cold-form the annular section into a series of teeth. This is accomplished by a rotary tooth forming tool unit 170 which is constructed and operated like the rotary tooth forming tool unit 70 to include a tooth forming periphery 172. The tool unit 170 is operated in the same manner as indicated before with at least portions of the sides of the teeth being free formed and the back-up space preferably filled with steel material, as is shown in FIG. 10. The finished toothed wheel in this embodiment is preferably machined along both of the side defining planes which are aligned with surfaces 164 and 166 at the trough plane.

Referring now more particularly to FIGS. 11–13, there is shown therein another variation in the process according to the present invention. Again, FIG. 11 illustrates a starting circular piece of steel sheet metal 214. The circular piece is then secured within a rotary holding unit, generally indicated at 252, which is constructed like the units 52 and 152 previously described. As before, the rotary holding unit 252 includes two rotary holding members 254 and 256, having an inner pair of central wall engaging surfaces 258 and 260 extending to an inner plane 261, a pair of exterior peripheral surfaces 262 and 263 and an outer pair of surfaces 264 and 266 extending from the surfaces 258 and 260 to the surfaces 262 and 263 coincident with the trough plane.

The circular piece 214 is secured between the members 254 and 256 in an operative relation so that a central wall 212 is engaged between the surfaces 158 and 160. The outer annulus of the circular piece 214 extending beyond the inner plane 161 is thickened to provide an annular section 246 which together with a portion filling the back-up space constitutes a preform. The cold-forming of the annular section is accomplished by the operation of a rotary thickening tool 268 having a U-shaped thickening slot 269 formed in the exterior periphery thereof outwardly of the back-up space defined by surfaces 264 and 266.

By advancing the rotary thickening tool 268 in conjunction with the rotation of the rotary holding unit 252, the outer annulus of the circular piece 214 is thickened into a solid annular section 246 having a width less than the width of the teeth to be formed. It will be noted that, during the thickening operation, the steel cold flows into substantial filling relation to the back-up space. The outer diameter of the annular section 246 is slightly greater than the crest diameter of the teeth to be formed.

A series of teeth are cold-formed in the solid annular section 246 by utilizing the flanged tooth forming tool unit 170 previously described in the same manner as previously described. Again both sides are machined in alignment with the surfaces 264 and 266 at the trough plane.

Figure 14:
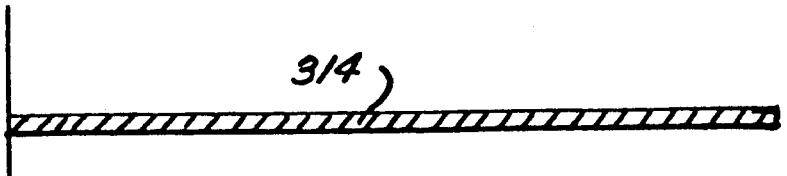
FIGS. 14–17 are view similar to FIGS. 2–6 illustrating steps in still another modification of the method of the present invention.
Figure 15:
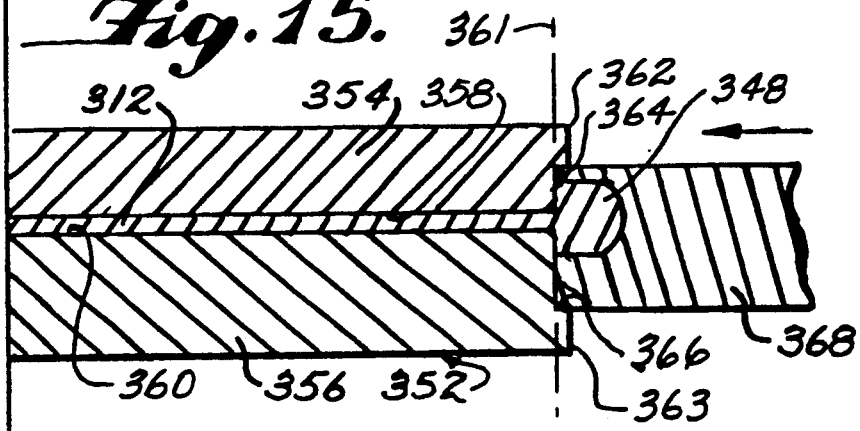
Figure 16:
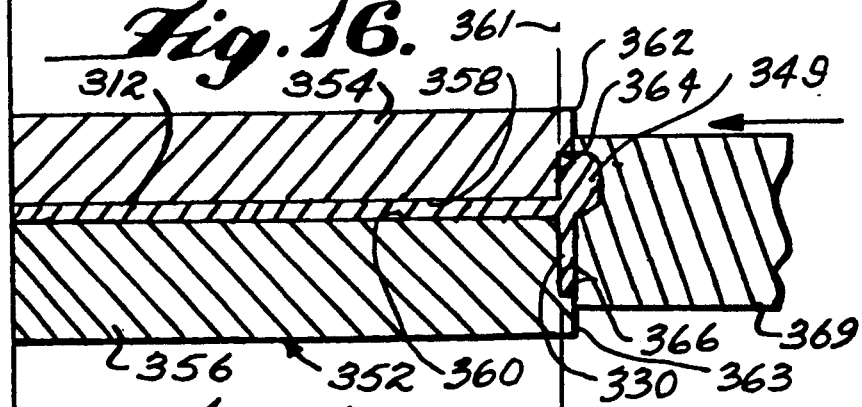
Figure 17:
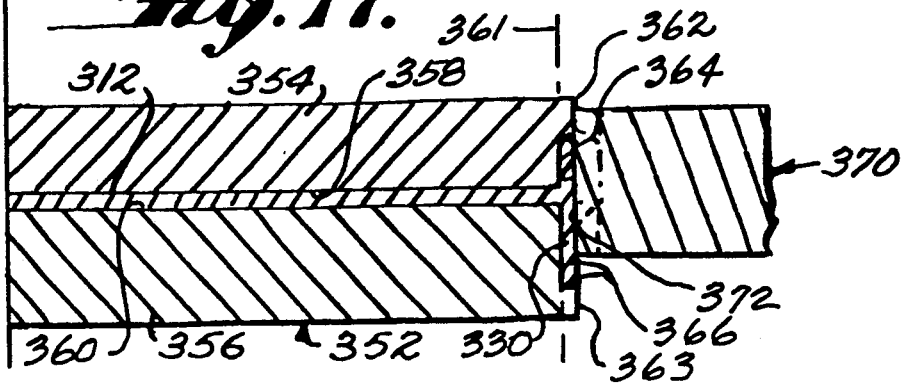

Referring now more particularly to FIGS. 14–17, there is shown therein still other modifications within the principles of the present invention. Here again, FIG. 14 illustrates a starting circular piece of steel sheet metal 314. The circular piece 314 is secured with a rotary holding unit 352 which is similar to the units 52, 152, and 252 previously described. As before, the unit 352 includes two rotary holding members 354 and 356. The holding members 354 and 356 when in operative relation with the piece 314 include an inner pair of central wall engaging surfaces 358 and 360 extending to an inner plane 361, a pair of exterior peripheral surfaces 362 and 363 which are within a trough plane outwardly of the inner plane 361 and an outer pair of surfaces 364 and 366 which extend from the surfaces 358 and 360 to the surfaces 362 and 363 so as to define a back-up spaced between the inner plane 361 and the trough plane.

As before, the circular piece 314 is secured in operative relation between the holding members 354 and 356 so as to extend generally axially outwardly from the inner plane 361 beyond the outer periphery of a central portion of the circular piece which constitutes a central wall 312. The annulus of the circular piece 314 is thickened into an initial solid annular section 348 by utilizing an initial thickening tool 368 in the same manner as the thickening tool 268. Thereafter, a second thickening tool 369 is used in a similar manner to cold-form the initial annular section 348 into a final solid annular section 349 having an axial flange 330 extending therefrom. As shown, the axial flange 330 is integral with the central wall 312 and contacts the surface 366 of holding member 356 along its inner periphery and the outer end thereof. The annular section 349 is integral with the end of the axial flange 330 which is integral with the central wall 312. Again, it will be noted that the annular section 349 has a width greater than the predetermined sheet steel thickness but less than the width of the teeth to be formed. Again, the steel material of the annular section 349 substantially fills the back-up space defined by the surfaces 364 and 366. Again, the outer periphery of the annular section 349 is slightly greater than the crest diameter of the teeth to be formed.

After the preform is cold-formed including central wall 312 and the annular section 349 including axial flange 330, the portion of the annular section 349 outwardly of the back-up space is cold-formed into a series of teeth. The teeth are formed by using a rotary tooth forming tool unit 370 similar to the units 70 and 170 in a similar fashion except for one difference. In all of the embodiments heretofore described, the outer periphery of the tooth-like projections on the tool periphery 72 or 172 have engaged or substantially engaged the exterior peripheral surfaces 62 and 63, 162 and 163, or 262 and 263, however in forming the teeth with the tooth-forming periphery 372, one side of the outer tips engages only the surface 362. The other side engages the outer surface of the flange 330.

This arrangement allows the sides of the teeth to be free formed as before. Also, as before, the back-up space is generally filled. With the provision of the flange 330, the toothed wheel is finished in the same manner as the wheel 10.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A method of forming a one-piece sheet metal toothed wheel including a central sheet metal wall of predetermined thickness and a series of cold-formed integral teeth on the periphery of the central wall defined by troughs extending radially inwardly therebetween to a cylindrical trough plane concentric with an axis of the central wall, said series of cold-formed integral teeth having an operative width defined by spaced tooth side defining planes, said method utilizing (1) a rotary holding unit which provides, when in holding relation, an inner pair of opposed central wall-engaging surfaces extending generally radially outwardly to a cylindrical inner plane spaced inwardly from an outer cylindrical plane of a size equal to said trough plane and an outer pair of back-up surfaces extending from said inner pair of opposed central wall-engaging surfaces at said inner plane to said outer plane where said outer pair of surfaces are spaced apart a predetermined distance which is greater than the spacing between said inner pair of surfaces so as to define a back-up space within an annulus between said inner and outer planes and (2) a rotary tooth-forming tool unit having a rotational axis and a tooth-forming periphery extending annularly about said rotational axis, said method comprising the steps of cold-forming a circular piece of sheet metal into a preform having an outer annular section of generally uniform cross-sectional configuration and an integral sheet metal central wall generally of said predetermined thickness extending generally radially inwardly from the outer annular section toward a preform axis, said outer annular section having (1) a width greater than said predetermined thickness but no greater than said predetermined distance, and (2) an outer periphery extending beyond said trough plane which will allow a meshing action with the tooth-forming periphery of the tooth-forming tool unit, rotating (1) said rotary holding unit with said preform secured thereto about the preform axis and an inner portion of said outer annular section within said back-up space and an outer portion of said outer annular section extending radially outwardly of said back-up space, and (2) said tooth-forming tool unit about the rotational axis thereof in a predetermined rotational relation wherein said axes are parallel and the rotational speeds are synchronized, and while said rotary holding unit with said preform secured thereto and said tooth-forming tool unit are in said predetermined rotational relation affecting a relative movement between said units and the axes thereof in a direction toward one another to engage the tooth-forming periphery of the tooth-forming tool unit in cooperating metal-deforming relation with the outer portion of said outer annular section inwardly of the exterior periphery thereof until the sheet metal of the outer portion of the annular section is cold-formed into said series of teeth and displaced from the troughs therebetween so that after the series of teeth are cold-formed the toothed wheel includes a back-up portion having surfaces conforming to an outer extent of each of said outer pair of surfaces defining said back-up space, the peripheries of said series of teeth being cold-formed by rolling contact with the tooth-forming periphery of the tooth-forming tool unit and the sides of the series of teeth including portions disposed outwardly beyond said spaced tooth side defining planes being free-formed without surface contact by the axially outward movement of the metal defining the outer portion of said outer annular section.

2. A method as defined in claim 1 wherein said rotary holding tool unit further provides a pair of cylindrical exterior peripheral surfaces extending axially in opposite directions from said outer pair of surfaces within said outer plane, and wherein at the end of the relative movement between said units towards one another to engage the tooth forming periphery of the tooth forming tool unit in cooperating relation with the outer portion of said outer annular section, the tooth forming periphery includes trough forming teeth-like projections having exterior tips which extend to said trough plane and substantially engage the exterior periphery surfaces of said rotary holding unit.

3. A method as defined in claim 2 wherein the spaced tooth side defining planes pass generally through the outer pair of surfaces spaced apart within said outer plane and the free-formed portions of the sides of said series of teeth at least along one common side are machined so that the machined sides of the teeth on said one common side are disposed in a common plane constituting one of said spaced tooth side defining planes.

4. A method as defined in claim 3 wherein the free-formed portions of both sides of said series of teeth are machined in common planes constituting both of said spaced tooth side defining planes.

5. A method as defined in claim 2 wherein said preform is formed by cold-forming a first annular wall portion in side-by-side relation to a second annular wall portion integral with a central portion of the circular piece of sheet metal so that the two side-by-side annular wall portions are integrally interconnected at their outer peripheries so as to form a non-thickened preform.

6. A method as defined in claim 5 wherein said non-thickened preform is cold-formed into a thickened final preform while secured to said rotary holding unit with said first annular wall portion overlying the back-up space by cold-rolling the integrally interconnected outer peripheries of said two side-by-side annular wall portions radially inwardly to thicken the outer portion of the annular wall portions and the integral interconnection therebetween.

7. The method as claimed in claim 6 wherein said non-thickened preform is formed by cold-forming an outer annular portion of the circular piece of sheet metal into a peripheral flange extending axially from a central portion thereof, cold-forming a portion of the peripheral flange into said two side-by-side annular wall portions integrally extending outwardly of a remaining portion of said peripheral flange, said central portion providing said central wall, said pair of side-by-side integrally interconnected annular wall portions providing said annular section, and the remaining portion of the peripheral flange providing a pulse ring.

8. The method as claimed in claim 7 wherein said predetermined rotational relation includes a simultaneous synchronous rotation of said units in opposite directional meshing engagement to one another through a multiplicity of revolutions including reversal of directions.

9. A method as defined in claim 2 wherein the circular piece of sheet metal is cold-formed into said preform while secured with the rotary holding unit by cold-rolling an outer annulus of the circular piece of sheet metal radially inwardly to an extent sufficient to thicken the outer annulus into said annular section.

10. The method as claimed in claim 2 wherein said preform is formed by cold-forming an outer annulus of the circular piece of sheet metal into a peripheral flange extending outwardly and then downwardly from a curved central portion thereof so as to provide a cross-sectional configuration form which opens generally radially inwardly, said central portion providing said central wall and said peripheral flange of arcuate cross-section providing said annular section.

11. The method as claimed in claim 1 wherein said preform is formed by securing a circular piece of sheet steel with the rotary holding unit so that an annulus extends outwardly of said inner plane, thickening the annulus into an initial solid annular section by cold-rolling, and then cold-rolling the initial solid annular section into a final solid annular section with an axial flange portion extending therefrom.

* * * * *